US006896018B2

(12) United States Patent
Deckard et al.

(10) Patent No.: US 6,896,018 B2
(45) Date of Patent: May 24, 2005

(54) VACUUM FLITCH TABLE SYSTEM

(75) Inventors: Bobby Deckard, Martinsville, IN (US); Andrew J. Klotz, Fishers, IN (US)

(73) Assignee: Capital Machine Company, Inc., Indianapolis, IN (US)

( * ) Notice: Subject to any disclaimer, the term of this patent is extended or adjusted under 35 U.S.C. 154(b) by 76 days.

(21) Appl. No.: 10/260,890

(22) Filed: Sep. 30, 2002

(65) Prior Publication Data

US 2004/0060613 A1 Apr. 1, 2004

(51) Int. Cl.[7] ..... B27L 5/00
(52) U.S. Cl. ..... 144/209.1; 251/63.5; 251/175
(58) Field of Search ..... 144/162.1, 178, 144/209.1, 211–214; 251/62, 63, 63.4–63.5, 148, 175

(56) References Cited

U.S. PATENT DOCUMENTS 3,633,613 A * 1/1972 Julow ..... 137/512.3
3,905,408 A 9/1975 Hale
3,907,268 A * 9/1975 Hale ..... 269/21
5,374,021 A * 12/1994 Kleinman ..... 248/362
5,385,184 A 1/1995 Mellor
5,590,700 A 1/1997 Brand
5,836,568 A * 11/1998 Ishigaki et al. ..... 251/148
6,367,770 B1 * 4/2002 Duelli ..... 251/175
6,431,518 B1 * 8/2002 Geiser ..... 251/62
6,460,564 B1 * 10/2002 Rief et al. ..... 137/456

* cited by examiner

*Primary Examiner*—Allen Ostrager
*Assistant Examiner*—Shelley Self
(74) *Attorney, Agent, or Firm*—Brinks Hofer Gilson & Lione

(57) ABSTRACT

Vacuum flitch-retaining systems use vacuum valves having pressure-operated reciprocatable pistons capable of high valve closure forces to provide the reliable closure of their associated valve seats, notwithstanding the presence of resin, wood fibers, dirt and other debris that may be present in the valves and on the valve seats, to control the application of vacuum to vacuum cells formed in a flitch-retaining table.

14 Claims, 4 Drawing Sheets

VACUUM FLITCH TABLE SYSTEM

BACKGROUND OF THE INVENTION

The present invention relates to vacuum flitch table systems and, more particularly, the invention relates to vacuum valves for flitch tables that can provide a reliable vacuum seal notwithstanding the presence of debris.

In the veneer slicing industry, a flitch is carried on a flitch table for slicing. The flitch is held in place on the flitch table by a set of dogs, and, typically, the table moves the flitch in a reciprocating motion past a slicing knife which slices the veneer from the flitch. Since the dogs can extend outwardly from the flitch table as much as ⅝ inch, a substantial thickness of the flitch is unavailable for slicing. Thus, the loss of up to as much as ⅝ inch of a flitch to slicing represents a major loss of product.

Vacuum flitch tables have been proposed to overcome the problem by eliminating the need for dogs. For example, U.S. Pat. No. 3,905,408 to Hale discloses a vacuum flitch table that includes a vacuum cell plate that incorporates a plurality of vacuum cells. Each vacuum cell is equipped with a check valve to open the cell to a vacuum source. When a flitch is placed on the flitch table, the flitch seals the vacuum cell and the check valve opens to impose vacuum on the vacuum cell and hold the flitch in place.

Conventional vacuum flitch tables suffer from a serious disadvantage in that the valves tend to get clogged by debris from the flitch, such as resin, dirt and splinters.

One attempt to overcome the problem of clogged valves is disclosed in U.S. Pat. No. 5,385,184 to Mellor. The '184 patent discloses a vacuum flitch table that incorporates a ball valve to open each cell to the vacuum source and positions a screen between the flitch and the ball valve to keep the valve from clogging with debris such as wood fibers and dust, sap, and the like. However, the problem was not completely solved because the debris collection point was merely moved from the valve to the screen. The screen collects the debris and eventually clogs. When the screen gets clogged, an operator must unclog the screens, typically by actuating a blow-back system to blow the debris out of the screen by compressed air.

Another attempt to overcome the problem of clogged vacuum valves for use with vacuum flitch tables is disclosed in U.S. Pat. No. 5,590,700 to Brand. The valve of the '700 patent was directed to the resistance of clogging and the elimination of blow-back systems by cutting debris that might otherwise interfere with operation of the valve each time the valve moved between an open and a closed position.

Notwithstanding these prior developments, a need remains for a valve to reliably control the application of vacuum to a vacuum flitch table in the presence of the resin, wood fibers, dirt and other debris that is inevitably drawn from the flitch by the applied vacuum.

SUMMARY OF THE INVENTION

Vacuum flitch-retaining systems of the invention use vacuum valves having pressure-operated reciprocatable pistons capable of high valve closure forces to provide the reliable closure of their associated valve seats, notwithstanding the presence of resin, wood fibers, dirt and other debris that may be present in the valves and on the valve seats, to control the application of vacuum to vacuum cells formed in a flitch-retaining table.

A vacuum flitch-retaining system of the invention includes a flitch table having a flitch mounting surface with a plurality of vacuum cells for retention of the flitch. A vacuum manifold, whose interior is connected with the source of vacuum, has a plurality of openings and carries a plurality of vacuum valves for controlling the vacuum applied to the vacuum cells of the flitch table. Each vacuum valve has a valve seat with an opening in communication with the interior of the vacuum manifold, and a valve operator comprising a pressure actuated piston/cylinder unit with its reciprocatable piston carried for reciprocation along the central axis of the valve seat. The opening of each valve seat is connected with one or more vacuum cells of the flitch table so that the opening and closing of each valve seat, and the application of vacuum to the vacuum cells of the flitch table and the retention of the flitch thereby, is controllable by the selective application of pressure to the valve operators. The vacuum manifold is preferably mounted with one end higher than the other end so that dirt, splinters, resin and other debris entering the manifold may be carried to the lower end of the vacuum manifold, which is preferably opposite the end connected to the vacuum source.

In a preferred embodiment of vacuum flitch retaining system of the invention, the vacuum valve of the vacuum flitch-retaining system comprises a valve body having an axial passageway with two ends and a transverse passageway in one side of the valve body intersecting the axial passageway between the two ends. A valve seat is formed about an opening on the central axis of the axial passageway between one end and the transverse passageway. The valve body is carried by the vacuum manifold, with said one end of the axial passageway and opening in communication with the vacuum manifold. A piston/cylinder unit is carried by the valve body at the other end of the axial passageway so that the piston of the piston/cylinder unit is reciprocatable within the axial passageway along its central axis and so that a valve seat closure carried at the projecting end of the piston can be forced into engagement with and close the valve seat formed at the other end of the valve body by the application of high pressure on the piston.

In another preferred embodiment a vacuum manifold has two opposing sides, each of the opposing sides having a plurality of opening portions, with the plurality of opening portions being arranged in transaxially aligned pairs, with one opening portion of each transaxially aligned pair being in one of the opposing sides of the vacuum manifold. One opening portion of each transaxially arranged pair of opening portions provides a valve seat, and the other opening portion of each transaxially aligned pair of openings carries a piston/cylinder unit having a reciprocatable piston, with a valve seat closure at its projecting end, operated by the application of pressure to its cylinder. Each piston/cylinder unit is carried by one of the opening portions of each transaxially aligned pair of opening portions with its reciprocatable piston being coaxially aligned with the valve seat carried by the other opening portion of the transaxially aligned pair so that reciprocation of the pistons forces the valve seat closure to open and close the valve seat.

The piston/cylinder units of the vacuum valves of this invention may be either double acting, with pressure inlets in the cylinder on the opposite sides of the cylinder-enclosed end of the piston, so the valve seat is opened and closed by the application of pressure to one or the other of the pressure inlets, or may be spring loaded within the cylinder, with the spring acting on the cylinder-enclosed end of the piston to urge the piston to a fail-safe position in the absence of pressure applied to the pressure inlet of its cylinder. In preferred valves of the invention, the valve seat is preferably formed by a concave frustoconical surface, and the valve seat closure has a mating convex frustoconical surface and preferably comprises a replaceable element, preferably a replaceable elastomeric washer.

Other features and advantages of the invention will be apparent from the drawings and more detailed description of the invention that follows.

DETAILED DESCRIPTION OF THE DRAWINGS

Figure 1:
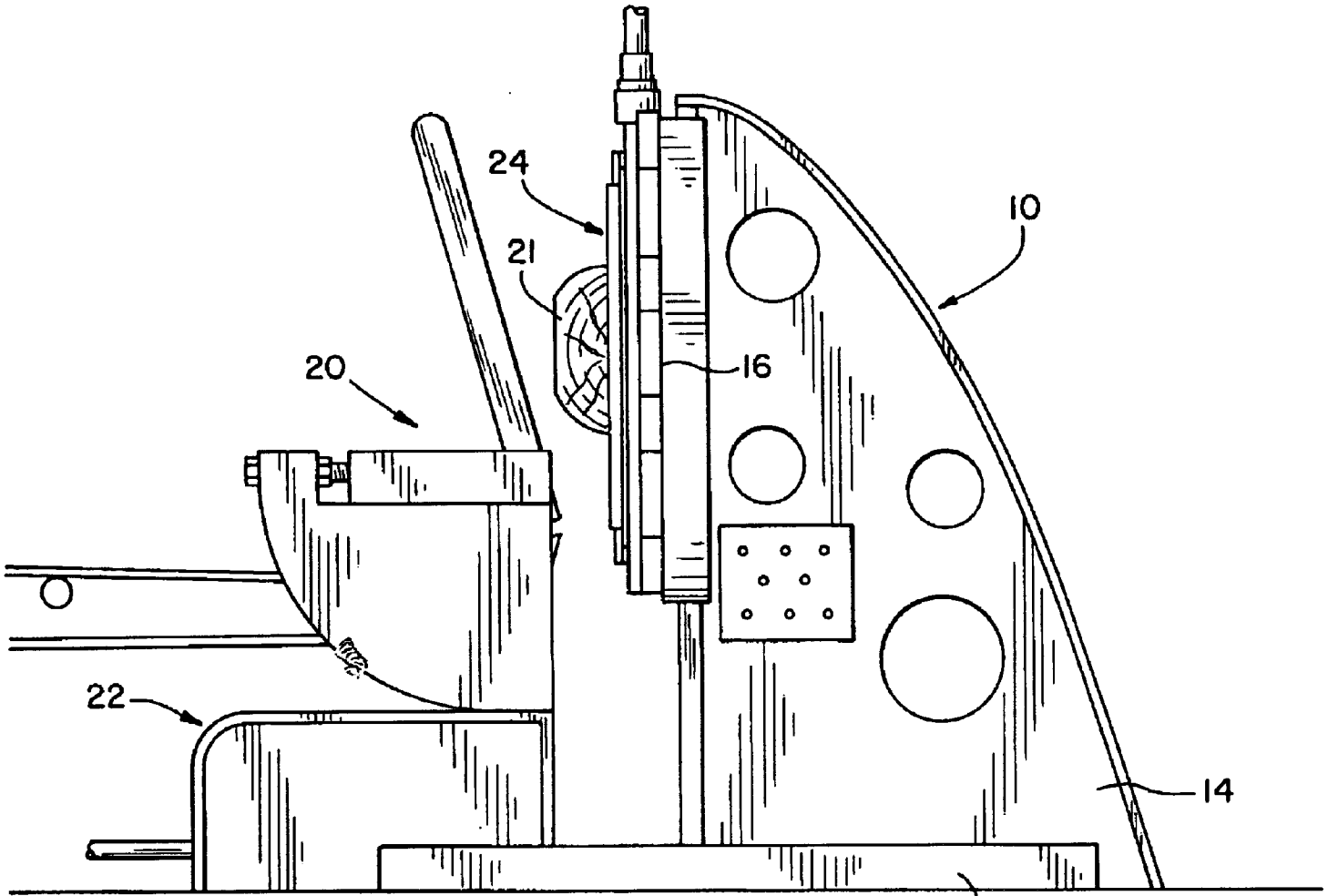
FIG. 1 is a diagrammatic side view of a veneer slicer for use with the present invention.
Figure 2:
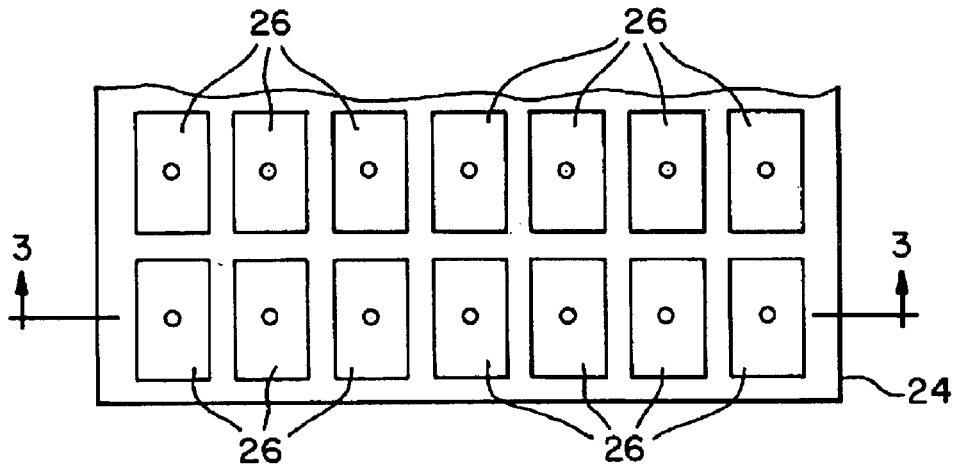
FIG. 2 is a diagrammatic view of a vacuum flitch table having a plurality of vacuum cell areas.

FIG. 1 illustrates a veneer slicing system incorporating a presently preferred embodiment of the invention. The system comprises a veneer slicing machine 10 that includes a base 12, a flitch table support 14, and a flitch table 16. A pressure cap and knife bar assembly 20 is coupled to a carriage 22, which moves the pressure cap and knife bar assembly 20 between a retracted position and a slicing position. The flitch table 16 includes a vacuum cell plate 24 that includes a plurality of conventional vacuum cell areas 26, as illustrated in FIG. 2. The combined area of the vacuum cell areas 26 should cover a substantial portion of the vacuum plate surface area, but the actual design, size, and placement of the cell areas 26 do not form a part of this invention.

Figure 3:
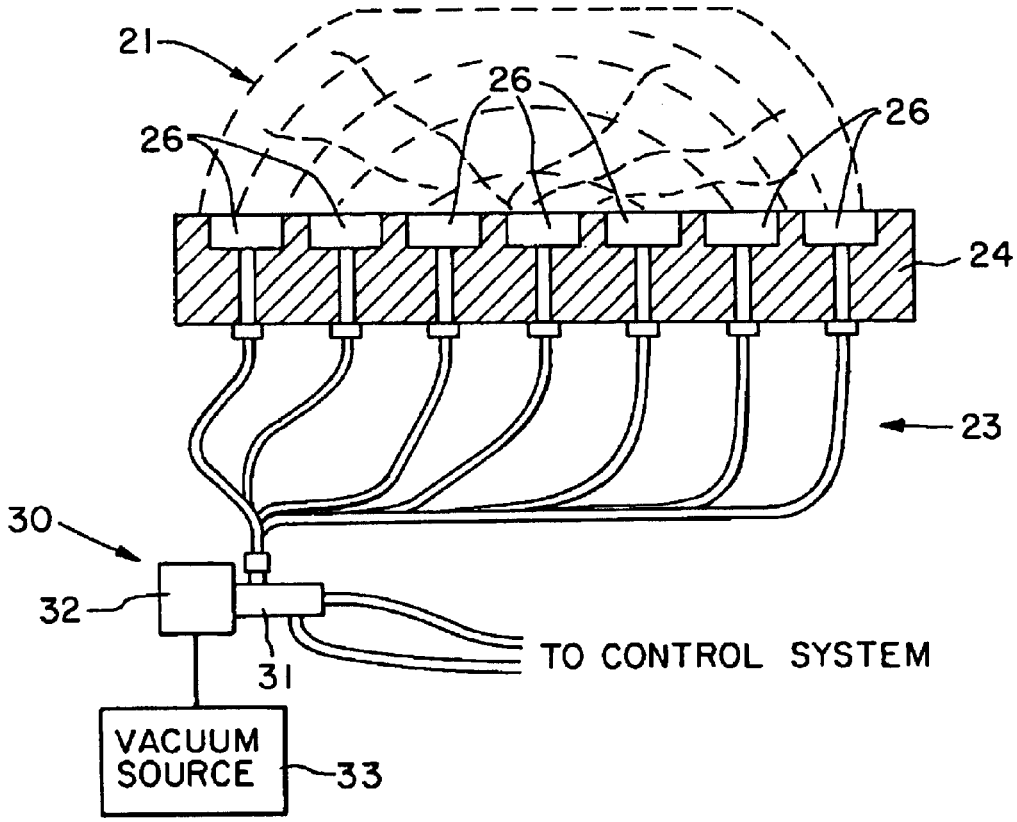
FIG. 3 is a simplified diagrammatic illustration of a portion of a vacuum flitch table system, including a cross-sectional view of the vacuum flitch table of FIG. 2 taken at a plane corresponding to line 3—3 of FIG. 2.

FIG. 3 is a diagrammatic illustration of a vacuum control system 30 of the invention including a cross-sectional view of the vacuum plate 24 of FIG. 2 taken at a plane perpendicular to the vacuum cell plate 24 through line 3—3, through a plurality of the vacuum cells 26. FIG. 3 indicates in dashed lines a flitch 21 as it would be retained on the vacuum cell plate 24 by the application of vacuum to the vacuum cells 26. As further illustrated by FIG. 3 the vacuum cells 26 are connected in the vacuum control system 30, by lengths of flexible tubing 23, such as polyethylene tubing, nylon tubing or the like, with a plurality of vacuum valves 31 (only one of which can be seen in FIG. 3) which are carried by a vacuum manifold 32. The vacuum manifold 32 is connected to a source of vacuum 33, and the plurality of vacuum valves 31 are operated to control the application of the vacuum in the manifold 32 to the plurality of vacuum cells 26 through the lengths of flexible tubing 23.

In the vacuum system of the invention sensors (not shown) are provided in the vacuum cell plate 24 at each of the four corners of each vacuum cell 26, and unless the vacuum control system receives signals from all four sensors at the corners of a vacuum cell 26, the vacuum valve 31 controlling the application of vacuum to that cell will not be operated. For example, as indicated in FIG. 3, the vacuum cell farthest right in FIG. 3 is not completely covered by the flitch 21 and the vacuum valve connected to that vacuum cell would not be operated to apply vacuum thereto.

Figure 5:
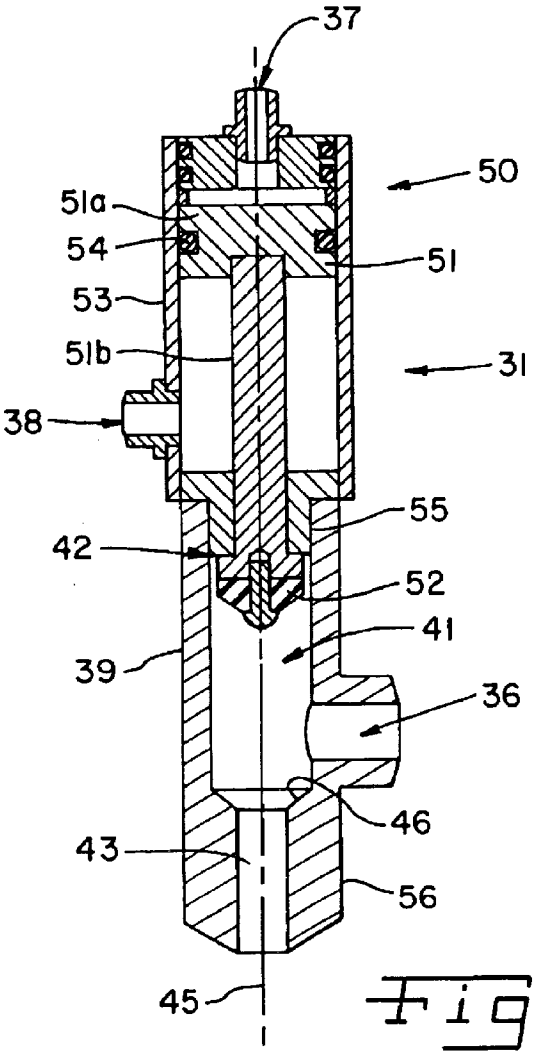
FIG. 5 is a cross-sectional view of one vacuum valves of FIG. 4 in the open position taken at a plane through its centerline.
Figure 4:
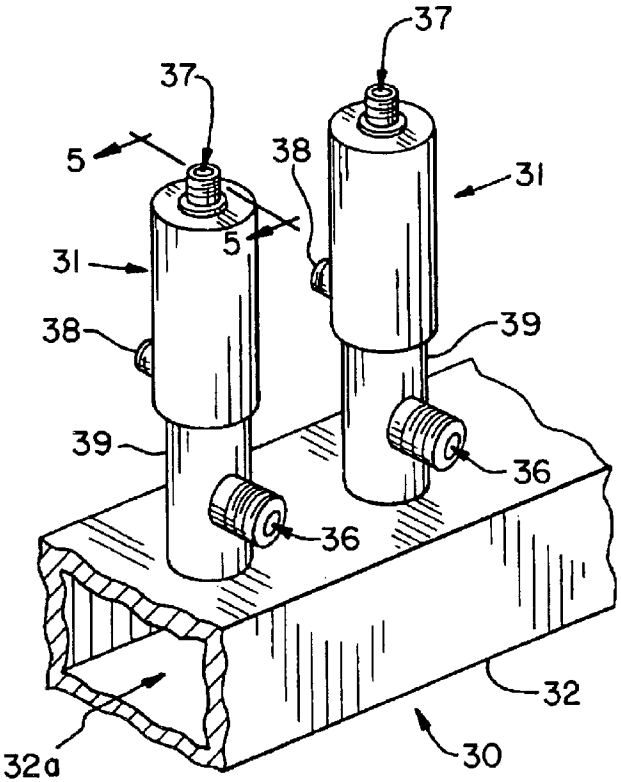
FIG. 4 is a perspective view of one embodiment of the invention including a portion of a vacuum manifold, partially broken away, and two vacuum valves.

FIG. 4 illustrates a portion of the vacuum control system 30, including a cutaway portion of the manifold 32 illustrating its interior 32*a*, which is connected to the vacuum source 33 (FIG. 3), and two vacuum valves 31 of the invention, whose construction and operation are described below. As illustrated in FIGS. 4 and 5, the vacuum valves 31 are pressure activated, double acting valves, having a vacuum output opening 36 and operating pressure input openings 37 and 38 formed in cylinder 53.

FIG. 5 is a cross-section of the vacuum valve 31 taken at a plane corresponding to line 5—5 through the center of vacuum valve 31, as shown in FIG. 4. As shown in FIG. 5, the vacuum valve 31 has a valve body 39 with an axial passageway 41 with two ends 42, 43 and with a transverse passageway 36 to serve as a vacuum outlet formed in one side of the body 39 intersecting the axial passageway 41 between the two ends 42, 43. The one end 43 of the axial passageway 41 is in communication with the vacuum manifold 32, as illustrated in FIG. 4. A valve seat 46 is formed about the central axis 45 of the axial passageway 41 between the end 43 of the axial passageway 41 that opens into the vacuum manifold 32 and the transverse passageway 36. A vacuum valve operator comprising a piston/cylinder unit 50 is threaded into the valve body 39 at its other end 42 and is positioned therein by its threaded engagement with the valve body 39. The piston/cylinder unit 50 includes a cylinder 53 and a reciprocatable piston 51 that has a cylinder-enclosed end 51*a* that is sealed with the cylinder 53 by an o-ring 54, and a projecting end 51*b* lying within the axial passageway 41 of the valve body 39 and carrying at its end a valve closure member 52. One end of the piston/cylinder unit 50 comprises a threaded extension 55 which is threaded into a threaded end 42 of passageway 41 of the valve body 39 so that the reciprocatable piston 51 and its projecting end 51*b* is movable along the central axis 45 of the valve seat 46. The valve seat 46 is formed within the valve body 39 around the end 43 of the axial passageway 41 which is in communication with the vacuum manifold 32. The piston/cylinder unit 50 is double-acting, in the most preferred embodiment of the piston/cylinder unit 50, with a pressure inlet on each side of the piston 51. The pressure inlet 37 permits the application of fluid pressure to the piston 51, moving the piston 51, its projecting end 51*b* and valve closure member 52 into engagement with the valve seat 46, closing the application of vacuum between the passageway 36 and passageway 43. The closure force acting on the valve closure member 52 can be increased by increasing the applied fluid pressure. The application of fluid pressure to pressure inlet 38 moves the piston 51, its projecting end 51*b* and the valve closure member 52 away from the valve seat 46, allowing the application of vacuum from the manifold 32 to vacuum outlet 36 which is connected by one of the lengths of flexible tubing 23 to one of the vacuum cells of the flitch table.

In systems of the invention the plurality of vacuum valves 31 are threaded at their ends 56 and are screwed into a vacuum manifold 32, as illustrated in FIG. 4, with their vacuum outlets 36 connected with the vacuum cells 26 of vacuum cell plate 24 through the flexible tubing 23, as illustrated in FIG. 3, and are operated by the application of pressure to the pressure inlets 37, 38 to control the application of vacuum to the flitch table.

Figure 6:
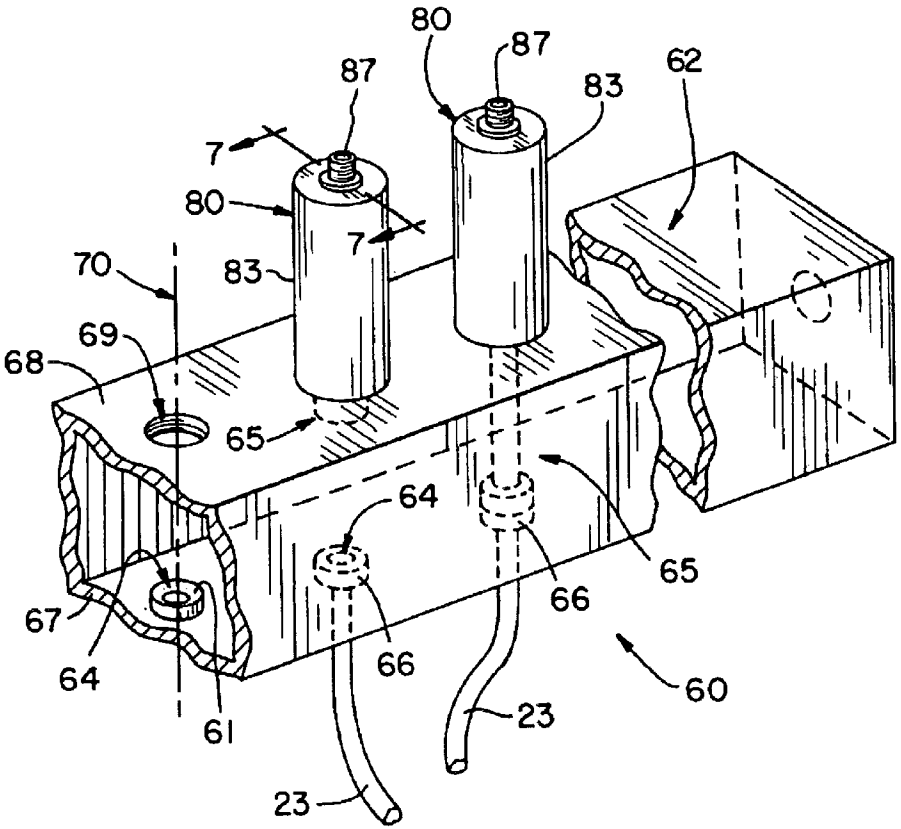
FIG. 6 is a perspective and partially broken away view of another embodiment of the invention, including a manifold and plurality of valves formed therewith.

FIG. 6 illustrates another embodiment 60 of a vacuum control system for the vacuum plate 24. FIG. 6 has been prepared to illustrate, in order from left to right: at the left, a pair of transaxially aligned openings of a manifold 62, the lower of which provides a valve seat 61, with a central opening; in the center, a vacuum valve 65 with a separate valve seat member 66, in the valve-open position; and farthest right, a vacuum valve 65 with a separate valve seat member 66, in the valve-closed position. Details of the elements, including the manifold 62, which form the valve are illustrated in FIG. 7, which is a cross-section, at a plane orthogonal to the manifold 62, including the central axis of the valve 65 in the open position, as indicated by the line 7—7 of FIG. 6.

The vacuum control system 60 includes a vacuum manifold 62 having two opposing sides 67, 68, one of which (67) provides an array of valve seats 61. As illustrated in FIG. 6, the opposing sides 67, 68 each have, preferably, a plurality of threaded opening portions 69 along the central portions of the sides 67, 68. As further illustrated by FIGS. 6 and 7, the threaded opening portions 69 are arranged in transaxially aligned pairs, with one threaded opening portion of each transaxially aligned pair being in one of the opposing sides 67, 68 of the manifold 62. "Transaxially aligned" means that each threaded opening portion 69 of each transaxially aligned pair of openings has the same central axis 70 that is transverse to the central axis of the manifold 62, as indicated in FIG. 6, so the manifold 62 can also function as the valve body of a plurality of vacuum valves. One threaded opening of each transaxially aligned pair of threaded openings provides a valve seat 61, which can be separate valve seat member 66 (shown in side 67), and the other threaded opening of each transaxially aligned pair of openings (shown in side 68) carries a piston/cylinder unit 80 having a reciprocatable piston 81 and rod 81*b* with the valve seat closure 52 at its projecting end. Each piston/cylinder unit 80 is carried by a threaded opening portion 69 of side 68 with its reciprocatable piston 81 and rod 81*b* coaxially aligned on the central axis 70 of one of the valve seats 61, 66 so that with the application of pressure to its pressure inlet 87, the reciprocatable piston 81 and rod 81*b* of the piston/cylinder unit 80 is forced along the central axis 70 of the valve seat 61, 66 and forces the valve seat closure 52 to mate with and close the central opening 64 of the valve seat 61,66, thereby removing vacuum from one of the flexible tubes 23 that is connected to one or more of the vacuum cells 26 of the flitch table 16.

Figure 7:
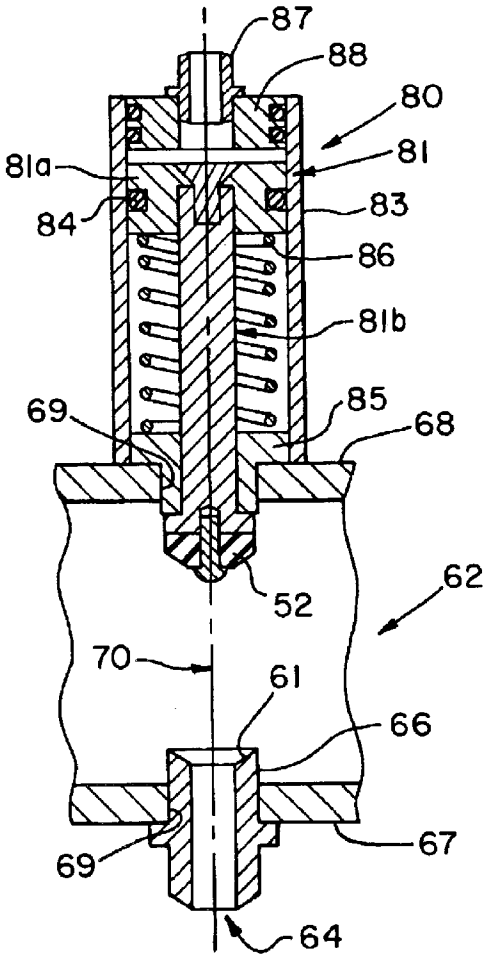
FIG. 7 is an illustration of the vacuum valve system shown in FIG. 6 taken at a plane through the centerline of the valve and orthogonally transverse to the manifold.

The vacuum control system illustrated by FIG. 6 includes a plurality of piston/cylinder units 80 which are shown in greater detail in FIG. 7. Each piston/cylinder unit 80 includes a cylinder 83 and a reciprocatable piston 81 that has a cylinder-enclosed end 81*a*, sealed with the cylinder 83 by an o-ring 84, and a projecting end of rod 81*b* extendable within the manifold 62 and carrying at its end a valve closure member 52. One end of the piston/cylinder unit 80 is closed by a threaded extension 85 which is threaded into one of the threaded opening portions 69 in side 68 so that the reciprocatable piston 81 is movable along the central axis 70 of the valve seat 66 in a trans-axially aligned threaded opening on the opposing side 67 of the manifold 62. As indicated by FIG. 7, the valve seat 61 is preferably provided by a separate valve seat member 66 with a central opening 64. The separate valve seat member 66 is threaded into one of the threaded opening portions 69 on side 67 of the manifold 62 centered on a central axis 70. While the piston/cylinder units 80 are preferably double-acting, as illustrated in FIG. 5, the piston/cylinder units 80 may include, as shown in FIG. 7, a spring 86 which is located within the cylinder 83 between the threaded cylinder closure end 85 and the cylinder-enclosed piston end 81 a of the reciprocating piston 81. The spring 86 holds the reciprocatable piston 81 in its retracted position in the absence of pressure applied to the pressure inlet 87 of the piston/cylinder unit 80. Upon the application of pressure to the pressure inlet 87 and between the cylinder closure member 88 and the cylinder-enclosed end 81a of the piston 81, the reciprocatable piston 81 is urged outwardly overcoming the force of spring 86 and moves along the central axis 70 until its valve seat closure member 52 is forced against the valve seat 61, as illustrated by the piston/cylinder unit 80 farthest right in FIG. 6, thereby removing vacuum from vacuum cells 26 connected with central opening 64 of valve seat member 66. With the valve of FIG. 7, spring 86 can maintain the piston/cylinder unit 80 in the valve-open position to apply vacuum to the vacuum cells 26 for fitch retention in the absence of pressure being applied to the piston/cylinder unit 80.

The vacuum manifold 32, 62 is preferably mounted closely adjacent the fitch table 16 to shorten the flexible hoses 23 that interconnect the valve openings 36, 47 with the vacuum cells 26 of the fitch table, and is preferably mounted with one end of the manifold 32,62 higher than the other end so gravity can urge debris and resin that may enter the manifold 32, 62 to the lower end of the manifold.

As illustrated above, the valve seats 46 and 61 are preferably frustoconical surfaces and the valve closure members 52 are, as illustrated, preferably replaceable elastomeric washers with mating frustoconical seating surfaces. The valve seat 46, 61 and valve closure member 52 may have other mating shapes, and valve closure member 52 may be comprised of other resilient material that will yield with the force applied by the piston 81 and thereby close the valve seat 46, 61 even if there is some debris or resin on the surface of the valve seat.

With the invention, very high valve closure forces can be applied to the valve seat, and valve seat closure materials may be adjusted to overcome debris that may collect on the valve seats. Although the valve has been illustrated as single-acting with the spring urging the valve closure member in its retracted position, double-acting valves are preferred for use in this invention so the pressure may be applied on either side of the reciprocatable piston, and the reciprocatable piston and valve closure member may be urged by pressure both into and out of engagement with the valve seats.

Those skilled in the art will recognize that the present invention has many applications and is not limited to the preferred embodiments illustrated and described herein, and is incorporated into all embodiments covered by the scope of the following claims, including those equivalents which are not obvious in view of the prior art.

We claim:

1. A vacuum valve for a vacuum flitch table, comprising a valve body having an axial passageway with two ends and a transverse passageway in one side of the body intersecting the axial passageway between the two ends, one end of the axial passageway being in communication with a vacuum source;

a valve seat formed about the central axis of said axial passageway between said one end and said transverse passageway;

a pressure-actuated piston/cylinder unit carried by the valve body at the other end of the axial passageway, the piston of said piston/cylinder unit having a cylinder-enclose end and a projecting end that is reciprocatable within the axial passageway along its central axis, said piston carrying at its projecting end a valve seat closure, the cylinder of said piston/cylinder unit having a pressure inlet on one side of the cylinder-enclosed end of the piston, whereby upon the application of pressure to said pressure inlet, the piston forces the valve seat closure against the valve seat.

2. The vacuum valve of claim 1, wherein the valve seat closure member comprises a replaceable elastomeric washer.

3. The vacuum valve of claim 2, wherein the valve seat is formed by a concave frustoconical surface and the valve seat closure has a mating convex frustoconical surface.

4. The vacuum valve of claim 1 wherein said cylinder has a second pressure inlet on the other side of the cylinder-enclosed end of the piston, whereby upon application of pressure to the second pressure inlet, the piston forces the valve seat closure away from the valve seat.

5. In a vacuum valve for a vacuum fitch table including a valve body carrying a valve seat and valve closure between a vacuum input opening and a vacuum output opening connectable to a vacuum cell formed in a fitch-retaining table, the improvement comprising a pressure-driven operator for the valve closure capable of generating high valve closure forces.

6. The vacuum valve of claim 5 wherein the improvement comprises a replaceable elastomeric washer carried by the valve closure.

7. The vacuum valve of claim 5 wherein the improvement comprises a valve body, having a threaded end, that is replaceably carried by a vacuum manifold and forms the vacuum input opening to the vacuum manifold.

8. A vacuum valve for a vacuum flitch table, comprising a valve body having an axial passageway with two ends and a transverse passageway in one side of the body intersecting the axial passageway between the two ends, one end of the axial passageway being in communication with the vacuum source;

a valve seat formed about the central axis of said axial passageway between said one end and the transverse passageway;

a double acting pressure-actuated piston/cylinder unit carried by the valve body at the other end of the axial passageway, the piston of said piston/cylinder unit having a cylinder-enclosed end and a projecting end that is reciprocatable within the axial passageway along its central axis, said piston carrying at its projecting end a valve seat closure, said cylinder having a first pressure inlet on one side of the cylinder-enclosed end of the piston and a second pressure inlet on the other side of the cylinder-enclosed end of the piston, whereby upon application of pressure to the first pressure inlet of the cylinder, the piston forces the valve seat closure against the valve seat removing vacuum from the transverse passageway; and upon application of pressure to the second pressure inlet the piston forces valve seat closure away from the valve seat so vacuum is applied to the transverse passageway.

9. The vacuum valve of claim 8, wherein the valve seat closure member comprises a replaceable elastomeric washer.

10. The vacuum valve of claim 8 wherein the valve seat is formed by a concave frustoconical surface and the valve seat closure has a mating convex frustoconical surface.

11. A vacuum valve for a vacuum fitch table, comprising a valve body having an axial passageway with two ends and a transverse passageway in one side of the body intersecting the axial passageway between the two ends, one end of the body being threaded, permitting the valve body to be replaceably carried by a vacuum manifold, and forming a vacuum inlet to said axial passageway;

a valve seat formed about the central axis of said axial passageway between said one end and said transverse passageway;

a pressure-actuated piston/cylinder at the other end of the valve body, said pressure-actuated piston having an end enclosed by said cylinder and a valve operating end projecting from said cylinder and reciprocatable within the axial passageway along its central axis, said piston carrying at its valve operating end a replaceable elastomeric valve seat closure, the cylinder having a pressure inlet on one side of the cylinder-enclosed end of the piston, whereby upon the application of pressure to said pressure inlet, the piston forces the elastomeric valve seat closure against the valve seat.

12. The vacuum valve of claim 11, wherein the valve seat is formed by a concave frustoconical surface and the valve seat closure has a mating convex frustoconical surface.

13. The vacuum valve of claim 11 wherein said cylinder has a second pressure inlet on the other side of the cylinder-enclosed end of the piston, whereby upon application of pressure to the second pressure inlet, the piston forces the valve seat closure away from the valve seat.

14. The vacuum valve of claim 11 wherein the other end of said valve body forms a threaded opening into said axial passageway and said cylinder and pressure-actuated piston comprise a separate piston/cylinder unit threadedly carried by said valve body.

* * * * *

UNITED STATES PATENT AND TRADEMARK OFFICE

CERTIFICATE OF CORRECTION

PATENT NO. : 6,896,018 B2
DATED : May 24, 2005
INVENTOR(S) : Bobby Deckard and Andrew J. Klotz It is certified that error appears in the above-identified patent and that said Letters Patent is hereby corrected as shown below:

Column 7,
Line 2, delete "enclose" and insert -- enclosed --.

Column 8,
Line 6, insert a comma -- , -- between "inlet" and "the".

Signed and Sealed this

Twenty-third Day of August, 2005

JON W. DUDAS
*Director of the United States Patent and Trademark Office*